US005881579A

United States Patent [19]

Ellingson

[11] Patent Number: 5,881,579

[45] Date of Patent: Mar. 16, 1999

[54] DOOR BOOT WITH VARYING ANGLE LIP SEAL

[75] Inventor: David I. Ellingson, Newton, Iowa

[73] Assignee: Maytag Corporation, Newton, Iowa

[21] Appl. No.: 851,373

[22] Filed: May 5, 1997

[51] Int. Cl.[6] ..... D06F 39/14

[52] U.S. Cl. ..... 68/24; 68/58; 68/139

[58] Field of Search ..... 68/139, 146, 58, 68/24; 34/601, 242, 75, 76, 77, 596, 597, 606

[56] References Cited

U.S. PATENT DOCUMENTS

| | | | |
|---|---|---|---|
| 2,424,737 | 7/1947 | Broglie | 34/601 |
| 2,500,062 | 3/1950 | Clark | 34/601 |
| 2,613,837 | 10/1952 | Morton | 220/15 |
| 2,625,031 | 1/1953 | Kreitchman | 68/139 |
| 2,835,048 | 5/1958 | Olthuis et al. | 34/242 |
| 2,899,816 | 8/1959 | Jacobsen, Jr. . | |
| 2,910,854 | 11/1959 | Hughes . | |
| 2,975,626 | 3/1961 | Frey | 68/139 |
| 3,276,229 | 10/1966 | Deiss | 68/139 |
| 3,429,056 | 2/1969 | Metzger | 34/601 |
| 3,816,942 | 6/1974 | Smith | 34/601 |
| 4,069,596 | 1/1978 | Sisler | 34/601 |
| 4,483,632 | 11/1984 | Triplett | 34/601 |
| 5,661,914 | 9/1997 | Millet | 34/601 |

FOREIGN PATENT DOCUMENTS

| | | | |
|---|---|---|---|
| 2040144 | 4/1971 | Germany | 34/242 |
| 17976 | 9/1935 | United Kingdom | 68/139 |
| 1426076 | 2/1976 | United Kingdom | 68/139 |
| 1488809 | 10/1977 | United Kingdom | 68/139 |
| 2114606 | 8/1983 | United Kingdom . | |

*Primary Examiner*—Frankie L. Stinson
*Attorney, Agent, or Firm*—Zarley, McKee, Thomte, Voorhees & Sease

[57] ABSTRACT

An improved door boot is provided for a laundry appliance. The door boot has a varying angle lip seal. The angle of the lip seal varies between ±15° from top to bottom relative to the planar orientation of the door boot. The varying angle of the lip seal ensures optimal sealing engagement with the door plug when the door is closed, particularly for an appliance having a tub tilted at an angle with respect to a horizontal plane.

15 Claims, 6 Drawing Sheets

DOOR BOOT WITH VARYING ANGLE LIP SEAL

BACKGROUND OF THE INVENTION

A conventional laundry appliance, such as a horizontal axis clothes washing machine, includes a cabinet with a drum rotatably mounted therein. In some machines, the drum is tilted slightly with respect to a horizontal axis. The appliance door is mounted to the cabinet so as to pivot about a vertical axis, thereby moving through a horizontal plane between open and closed positions. A seal is provided between the door and the open end of the tub. The seal typically is a rubberized door boot mounted to the cabinet and extending slightly into the tub through the open end thereof. The door boot includes a tubular lip seal adapted to sealingly engage with the plug of the door when the door is closed.

In the conventional door boot, the lip seal is parallel to the planar orientation of the door boot. Thus, on an inclined or tilted tub, the planes of the door boot and the lip seal are non-vertical. In a tilted tub appliance, the tilted angle of the door boot causes the horizontally movable door to engage the lip seal at a slightly varying angle from the top of the lip seal to the bottom of the lip seal. In order to ensure optimal sealing between the lip seal and the door plug, the lip seal should extend at substantially 90° angle relative to the horizontal movement of the door and the door plug.

Accordingly, a primary objective of the present invention is the provision of an improved door boot with a varying angle lip seal.

Another objective of the present invention is the provision of an improved door boot for a laundry appliance having a tub tilted with respect to a horizontal axis.

A further objective of the present invention is the provision of a door boot having a lip seal with an angle which varies between approximately ±15° relative to the planar orientation of the door boot.

Another objective of the present invention is the provision of an improved lip seal for a door boot of a laundry appliance which is effective and durable in use.

These and other objectives become apparent from the following description of the invention.

SUMMARY OF THE INVENTION

An improved door boot for a laundry appliance is provided. The laundry appliance generally includes a cabinet with a tub rotatably mounted in the cabinet. The tub has an open end, with the door boot being mounted to the cabinet and extending around the open end of the tub to define an access opening into the tub. A door is pivotally mounted on the cabinet for movement through a horizontal plane between open and closed positions. The door includes a door plug adapted to extend into the access opening when the door is in the closed position and sealingly engage the lip seal. The lip seal has a varying angle from top to bottom, relative to the planar orientation of the door boot. Preferably, the angle of the lip seal extends between approximately ±15°, when the tub is tilted at approximately a 15° angle relative to a horizontal plane. Accordingly, at the 12 o'clock position, the lip seal is at a ±15° angle and is at a −15° angle at the 6 o'clock position. At the 3 o'clock and 9 o'clock positions, the lip seal is substantially parallel to the planar orientation of the door boot.

DETAILED DESCRIPTION OF THE DRAWINGS

Figure 1:
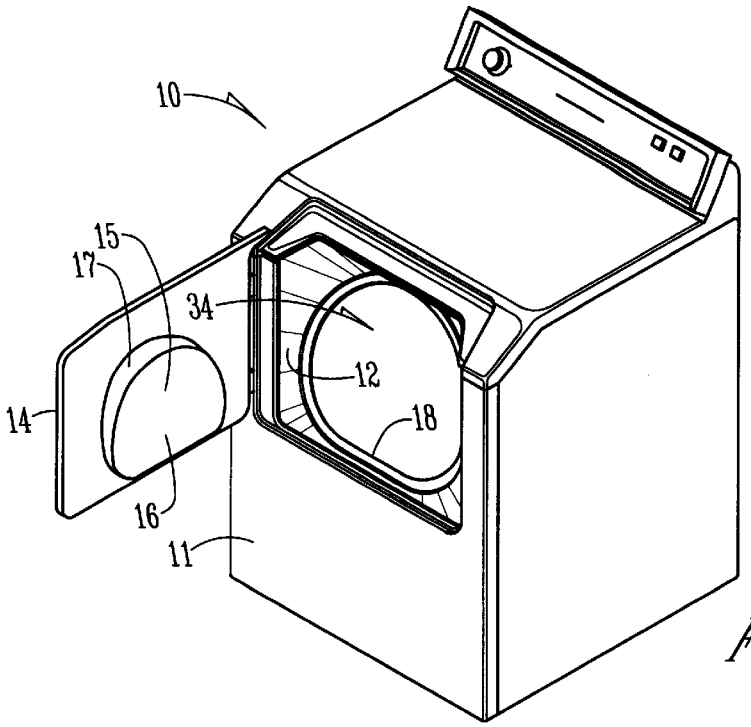
FIG. 1 is a perspective view of a laundry washing machine having a tilted axis tub and the door boot of the present invention.
Figure 2:
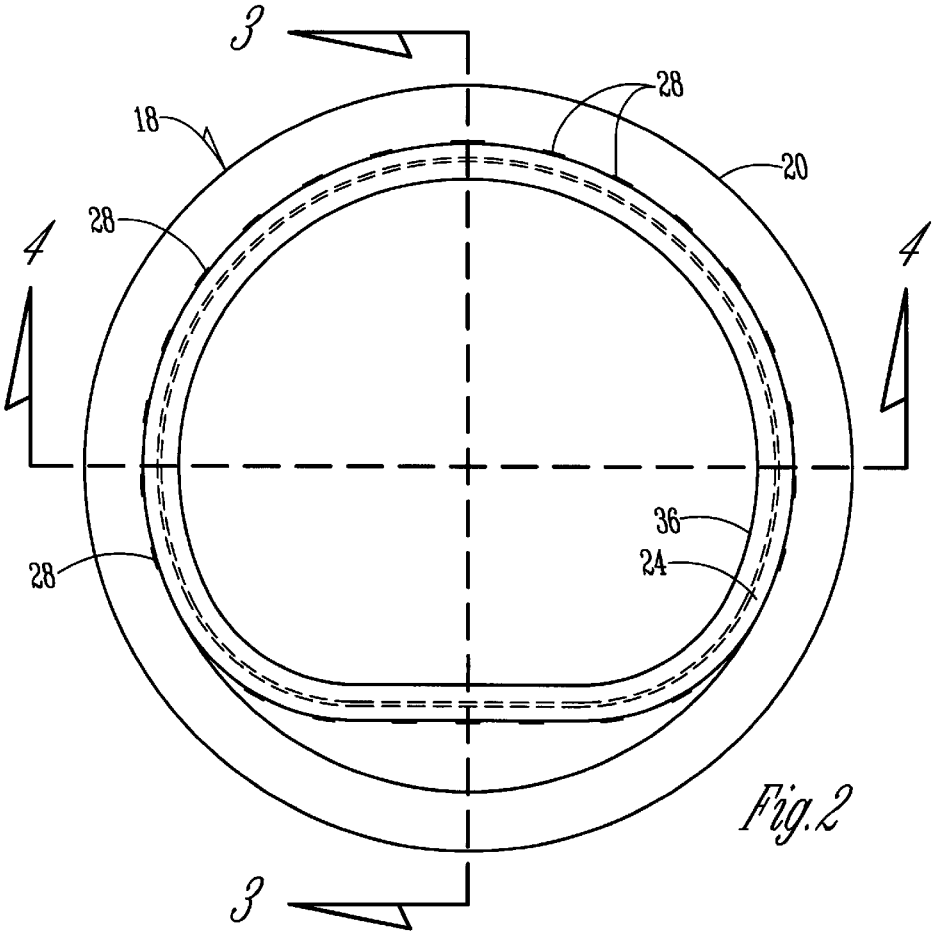
FIG. 2 is a front elevational view of the door boot with the varying angle lip seal of the present invention.
Figure 3:
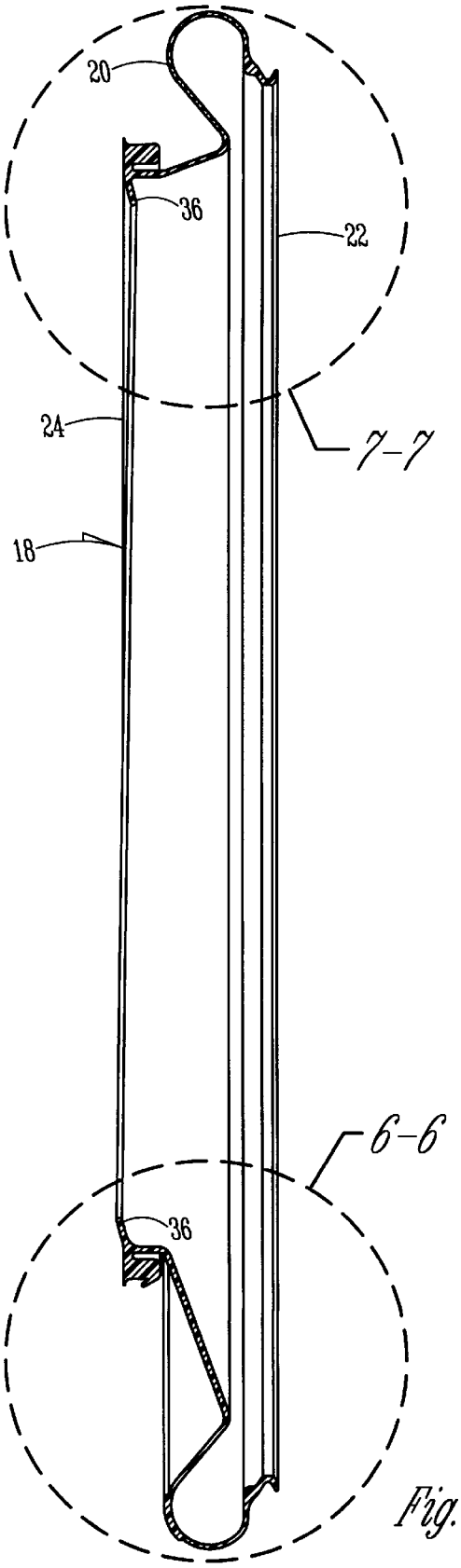
FIG. 3 is a sectional view taken along lines 3—3 of FIG. 2.
Figure 4:
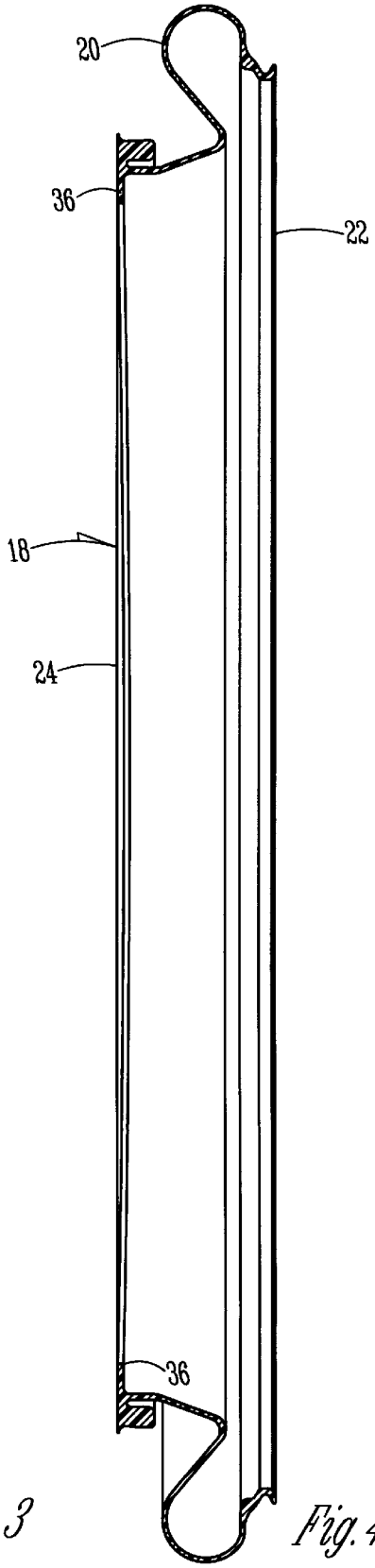
FIG. 4 is a sectional view taken along lines 4—4 of FIG. 2.

In the drawings, a laundry appliance, such as a washing machine, is generally designated by the reference numeral 10. The appliance 10 includes a cabinet 11, a tub rotatably mounted within the cabinet, a shroud 12 extending from the tub to the front of the cabinet 11, and a door 14 mounted on hinges for pivotal movement about a vertical axis and through a horizontal plane between open and closed positions. The door 14 includes a door plug 16 with a planar front surface 15 and a substantially cylindrical sealing surface 17.

Figure 5:
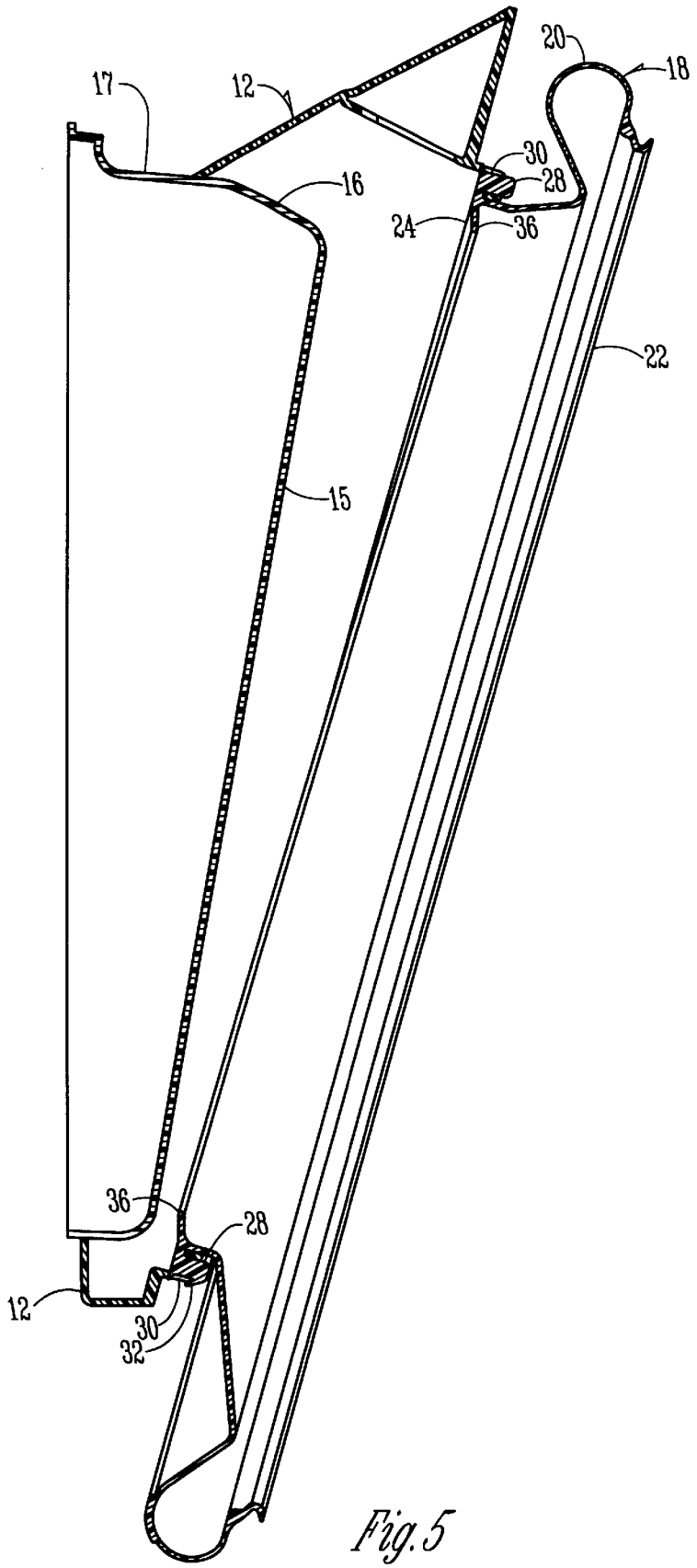
FIG. 5 is a sectional view taken along a central vertical plane showing the door boot mounted to the cabinet of the laundry appliance.
Figure 6:
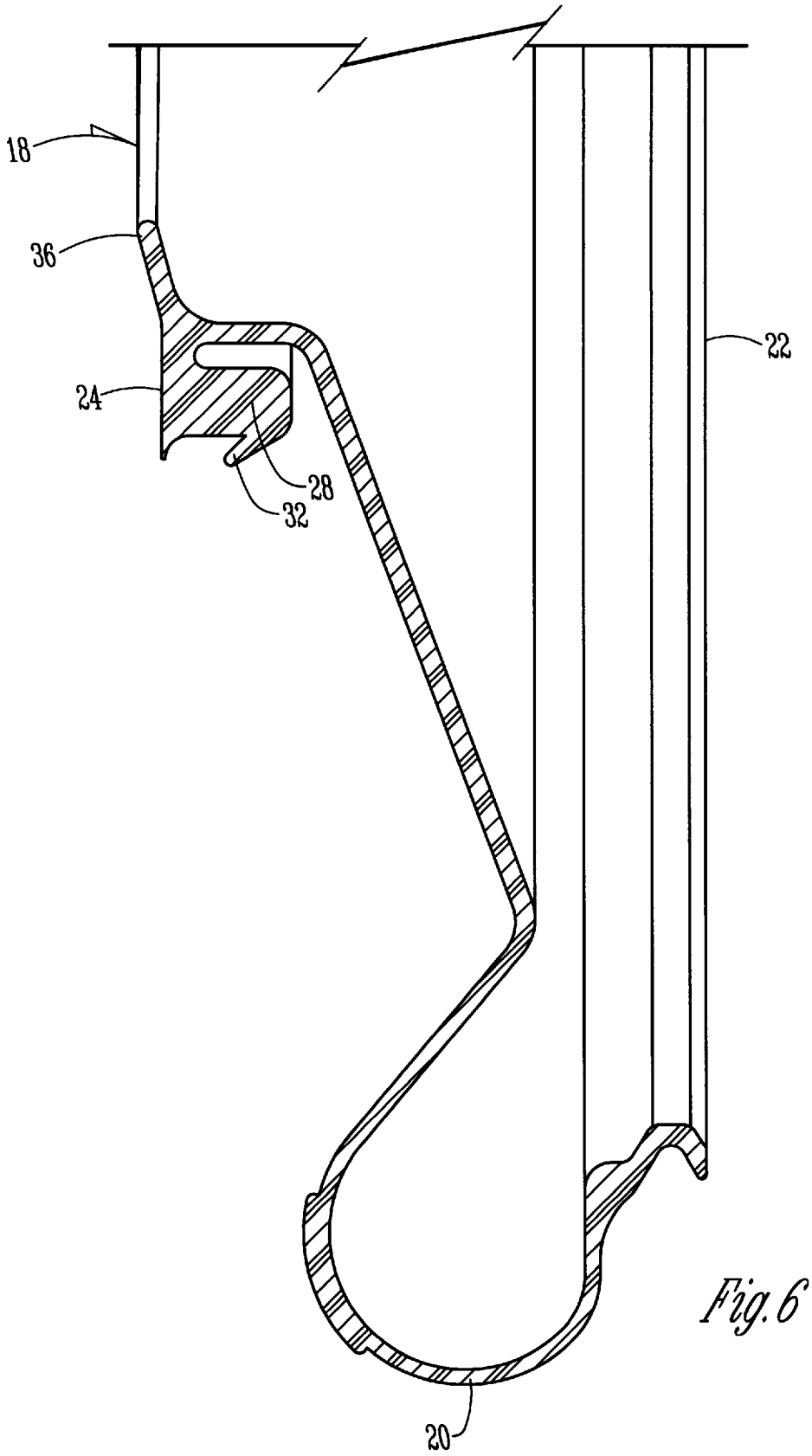
FIG. 6 is an enlarged view taken along lines 6—6 of FIG. 3.
Figure 7:
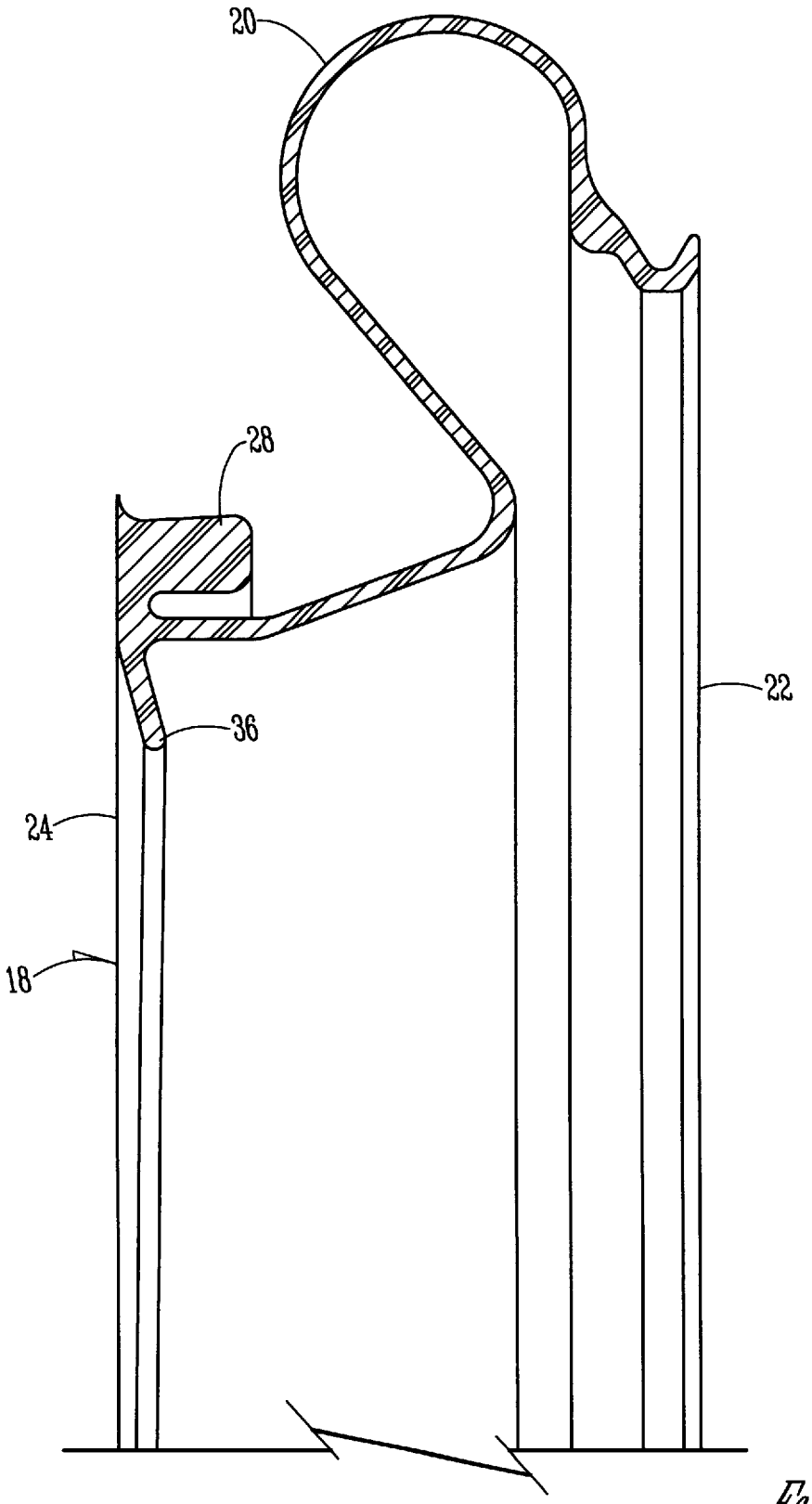
FIG. 7 is an enlarged view taken along lines 7—7 of FIG. 3.

The present invention is directed towards a door boot 18. The door boot 18 is tubular in shape and includes a base portion 20 having an inner side 22 and an outer side 24. The outer side 24 of the base portion 20 of the door boot 18 includes a plurality of mounting tabs 28 adapted to fit within a corresponding aperture 30 in the cabinet 11, as best seen in FIG. 5. The mounting tabs 28 may include a resilient retainer 32 which can be depressed to fit through the aperture 30 and then deflected radially outwardly to retain the door boot 18 in position on the cabinet 11. When the door boot 18 is mounted on the cabinet 11, the door boot defines an access opening 34 into the tub 12.

Figure 9:
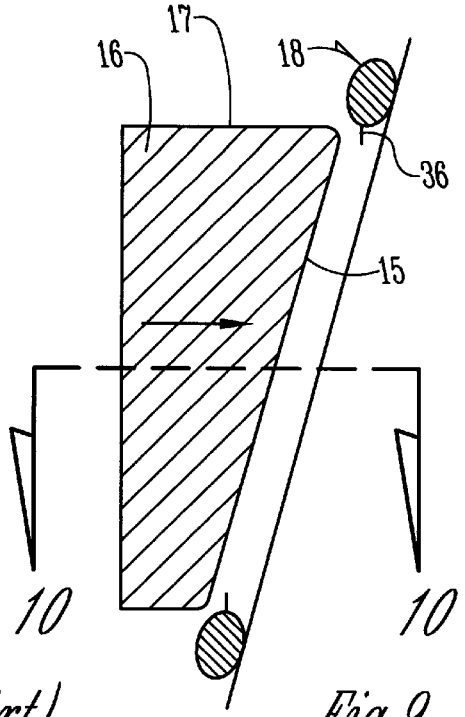
FIG. 9 is a schematic view similar to FIG. 8 showing the door boot with a varying angle lip seal according to the present invention.
Figure 10:
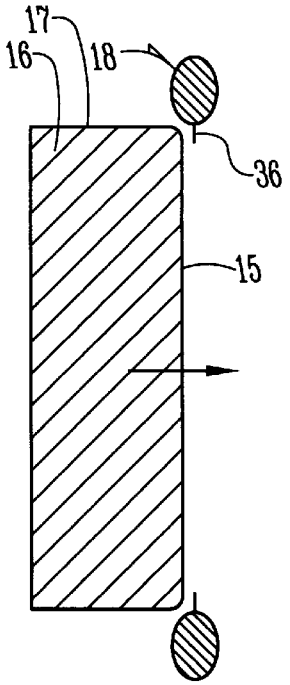
FIG. 10 is a schematic sectional view taken along a horizontal plane through the 3 o'clock and 9 o'clock positions showing the door boot of the present invention.

The door boot 18 also includes a varying angle lip seal 36 which provides sealingly engagement with the door plug 16 when the door 14 is closed. The angle of the lip seal 36 varies relative to the planar orientation of the door boot 18 and access opening 34. For a tub which is tilted approximately 15° relative to a horizontal plane, the door boot is inclined approximately 15° from a vertical plane, as seen in FIG. 9. According to the present invention, the angle of the lip seal 36 varies from ±15° from top to bottom. In other words, at the 12 o'clock position at the top of the door boot 18, the lip seal 36 is oriented +15° from the planar angle of the door boot 18. At the 6 o'clock position, the lip seal 36 is oriented at −15° from the planar angle of the door boot 18. At the 3 o'clock and 9 o'clock positions, the lip seal is parallel, or at 0°, relative to the door boot angle. Since the door plug 16 moves in a horizontal path as the door 14 is closed, the engagement between the door plug 14 and the lip seal 36 is at a varying angle. Therefore, the varying angle of the lip seal 36 ensures optimal sealing engagement between the door plug 16 and the lip seal 36. As seen in FIGS. 9 and 10, the lip seal 36 is substantially vertical throughout its perimeter, despite the door boot 18 being angularly oriented. This angular orientation of the lip seal 36 sealingly engages the sealing surface 17 on the door plug 16, thus making the contact force between the door plug consistent around the perimeter of the seal.

Figure 8:
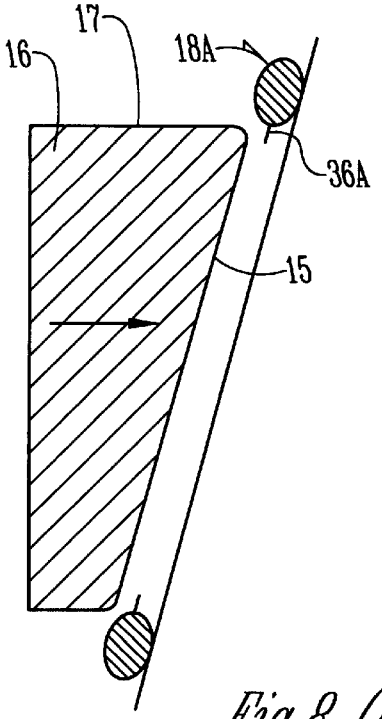
Fig.8 (Prior Art)
FIG. 8 is a sectional schematic view taken along a vertical plane through the 6 o'clock and 12 o'clock positions showing the orientation of a prior art door boot and lip seal.

In comparison, in the prior art tilted tub design, as shown in FIG. 8, the lip seal 36A is always parallel to the planar angle of the door boot 18A, rather than angled with respect thereto, as in the present invention. The constant parallel relationship between the prior art lip seal 36A and the plane of the door boot 18A does not ensure sealing engagement between the prior art lip seal 38A and the door plug 16A.

Whereas the invention has been shown and described in connection with the preferred embodiments thereof, it will be understood that many modifications, substitutions, and additions may be made which are within the intended broad scope of the following claims. From the foregoing, it can be seen that the present invention accomplishes at least all of the stated objectives.

What is claimed is:

1. An improved door boot for a laundry appliance including a cabinet, a tub rotably mounted in the cabinet and having an open end, a door boot mounted in the cabinet and extending around the open end of the tub to define an access opening into the tub, and a door pivotally mounted on the cabinet for movement between open and closed positions and having a plug adapted to extend into the access opening when the door is in the closed position, the improvement comprising:

a lip seal on the door boot to provide sealing engagement with the door plug; and the lip seal having a varying angle from top to bottom relative to the door boot.

2. The improved door boot of claim 1 wherein the angle of the lip seal extends between approximately ±15°.

3. The improved door boot of claim 1 wherein the access opening defines a plane and the lip seal is oriented approximately parallel to the access opening plane at 3 o'clock and 9 o'clock positions, approximately +15° relative to the access opening plane at a 12 o'clock position, and approximately −15° relative to the access opening plane at a 6 o'clock position.

4. The improved door boot of claim 1 wherein the lip seal extends 360°.

5. An improved door boot for a laundry appliance including a cabinet, a tub rotably mounted in the cabinet and having an open end, a tubular door boot mounted in the cabinet and extending around the open end of the tub to define an access opening into the tub, and a door pivotally mounted on the cabinet for movement between open and closed positions and having a plug adapted to extend into the access opening when the door is in the closed position, the improvement comprising:

a lip seal mounted on the door boot to provide sealing engagement with the door plug;

the lip seal being oriented at an angle relative to the door boot.

6. The improved door boot of claim 5 wherein the angle of the lip seal varies from top to bottom.

7. The improved door boot of claim 6 wherein the angle of the lip seal extends between approximately ±15° around the door boot.

8. The improved door boot of claim 5 wherein the lip seal extends around the door boot.

9. An improved laundry appliance including a cabinet, a tub rotably mounted in the cabinet at an angle tilted with respect to a horizontal axis, and a door pivotally mounted on the cabinet for movement between open and closed positions relative to the tub, the improvement comprising:

a tubular door boot mounted on the cabinet so as to reside in a non-vertical plane;

a lip seal on the door boot to provide sealing engagement with the door; and the lip seal being substantially vertically oriented.

10. The improved laundry appliance of claim 9 wherein the angle of the lip seal relative to the plane of the door boot varies from top to bottom.

11. The improved laundry appliance of claim 10 wherein the angle of the lip seal relative to the door boot plane varies between approximately ±150.

12. The improved laundry appliance of claim 9 wherein the lip seal is tubular.

13. A sealing system for an appliance comprising:

a cabinet enclosing the appliance;

an opening in the cabinet for providing access into the appliance;

a door boot extending around the periphery of the access opening in substantially a single plane;

a door capable of movement between an open position and a closed position and having a door plug with a substantially planar surface and a substantially cylindrical sealing surface;

a lip seal formed at an angle relative to the plane of the door boot so as to maintain an approximately perpendicular relationship with the sealing surface of the door plug, the lip seal engaging the door plug upon movement of the door to the closed position.

14. The sealing system of claim 13 wherein the lip seal angle varies between approximately ±15° from top to bottom.

15. The sealing system of claim 13 wherein the lip seal extends 360° around the door boot.

* * * * *